US006416150B1

(12) United States Patent
Kimura

(10) Patent No.: US 6,416,150 B1
(45) Date of Patent: Jul. 9, 2002

(54) INK JET PRINTER AND METHOD FOR PRINTING IN THE INK JET PRINTER

(75) Inventor: Shigeru Kimura, Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/392,023

(22) Filed: Sep. 8, 1999

(30) Foreign Application Priority Data

Sep. 8, 1998 (JP) ..... 10-253958

(51) Int. Cl.[7] ..... B41J 2/01; B41J 2/07
(52) U.S. Cl. ..... 347/14; 347/10; 347/11
(58) Field of Search ..... 347/10, 12, 11, 347/14

(56) References Cited

FOREIGN PATENT DOCUMENTS

| | | |
|---|---|---|
| EP | 0670224 | 9/1995 |
| JP | 56146769 | 11/1981 |
| JP | 4-67954 | 3/1992 |
| JP | 4-173250 | 6/1992 |
| JP | 6-45244 | 6/1994 |
| JP | 6-344652 | 12/1994 |
| JP | 7-205454 | 8/1995 |
| JP | 7-256874 | 10/1995 |
| JP | 8-258252 | * 10/1996 |
| JP | 9-150507 | 6/1997 |
| JP | 10-81012 | 3/1998 |
| JP | 10-81014 | 3/1998 |
| WO | 93/24330 | 12/1993 |
| WO | 98/08687 | 3/1998 |

OTHER PUBLICATIONS

European Search Report issued Sep. 15, 2000 in a related application (in English).
Japanese Office Action issued Dec. 12, 2000 in a related application with English translation of relevant portions.

* cited by examiner

*Primary Examiner*—Huan Tran
(74) *Attorney, Agent, or Firm*—Ostrolenk, Faber, Gerb & Soffen

(57) ABSTRACT

An ink jet printer includes a switch board for specifying a type of a recording sheet, printing speed and a resolution, a mode selection section for selecting a printing mode based on the input from the switch board. The driving pulse for driving the piezoelectric element is selected based on the printing mode and the result of analysis of the print data as to the density of the ink dots for avoiding blotting, bleeding and mixing of the ink.

15 Claims, 19 Drawing Sheets

INK JET PRINTER AND METHOD FOR PRINTING IN THE INK JET PRINTER

FIELD OF THE INVENTION

The present invention relates to an ink-jet printer capable of printing data with high printing quality. The present invention also relates to a printing method in an ink jet printer.

DESCRIPTION OF THE RELATED ART

A non-impact recording technique is superior to other techniques due to its lower noise operation during recording, and thus is increasingly highlighted. Among other non-impact recording techniques, an ink jet recording technique has advantages that a high-speed recording can be obtained with a relatively simple structure and that plain paper can be used for a recording sheet.

Various methods have been proposed in the ink jet printing technique heretofore. An example of such methods uses ink droplets ejected by a recording head to attach onto a recording sheet and form characters or figures thereon. This method has an advantage that a fixing step is unnecessary to the record formed on plain paper as well as an advantage of a higher-speed printing, and thus various types of ink-jet printers using this method are increasingly used.

The ink-jet printers as described above are categorized roughly into three types including a continuous injection type, an on-demand type (or impulse type), and an electrostatic absorption type. The on-demand type, which ejects ink only when it is required, has an advantage of low ink consumption as well as a simple structure and is expected to be widely used.

The ink-jet printer of the conventional on-demand type, described in Patent Publication JP-B-6-45244, uses a thinning out technique for prevention of ink from blotting or running. In this ink-jet printer, the amount itself of the ejected ink in each droplet is increased when the thinning out technique is used compared to the case of an ordinary printing, thereby avoiding weakness of the record.

In the described printer, however, the thinning out technique involves a poor resolution irrespective of the increased amount of ink to thereby degrade the printing quality.

The ink-jet printer of the on-demand type, described in Patent Publication WO93/24330, achieves a high-quality printing by printing with black ink after printing with underlying color ink at a black region in the vicinity of the boundary between the black region and an adjacent colored region. More specifically, in the described printer, if there is a black region and a colored region adjacent to each other in the printing, color printing is first conducted on the black region as an underlying layer for the black ink printing, thereby preventing bleeding of ink between both the regions.

In the described printer, since the printer uses a thinning out technique, printing quality is poor due to a lower resolution. In addition, the underlying black-ink layer consumes a large amount of black ink, and increases blotting of ink or paper damage.

Patent Publications JP-A-10-81014 and -10-81012 describe ink-jet printers wherein gray-scale printing is conducted by changing the amount of ejected ink and thus changing the dot diameter of the ink dot by using a plurality of driving pulses. In these publications, a smaller ink droplet and a larger ink droplet are continuously ejected from a single ink nozzle onto the recording sheet for merging therebetween on the recording sheet.

In this technique, the larger dot diameter increases overlapping area between ink dots, which damages the recording sheet.

On the other hand, another printing technique is also known in the art wherein two different resolutions are obtained using a single waveform of the driving pulse for an ink nozzle. In this technique, the higher resolution is obtained by doubling the ordinary resolution both in the longitudinal and transverse directions while forming the dots in a zigzag line by offsetting every other dot by a half of the dot diameter to thereby preventing blank area in the record.

In this technique, the waveform of the driving pulse is common for a plurality of printing operations using different speeds and different resolutions. This involves, however, increase of dot diameters, and thus increases the overlapping areas of the printed dots, which in turn causes a damage for the recording sheet. In this technique as well as the technique described just above, the driving pulse for the piezoelectric elements is constant irrespective of difference between the types of the recording sheets, i.e., constant whether the data is printed on a plain paper or a dedicated printing sheet, by using a common dot diameter. This causes blotting of ink on the dedicated printing sheet to degrade the printing quality and paper damage of the dedicated printing sheet. This also causes smaller dot diameter of the record on a plain paper due to excessively smaller blotting, which causes weakness of the record or causes dotted lines due to incomplete printing.

Other ink-jet printers, described in Patent Publications JP-A-7-256874, -7-205454 and 4-173250, reduce bleeding of inks at the boundary between different colored regions. More specifically, the described printers, each having a recording head wherein a black ink nozzle and a plurality of color ink nozzles are arranged in a longitudinal direction, operates overlap printing at the boundary by printing with a plurality of color inks while reducing the bleeding. In this technique, printing with black ink is conducted while using a scanning technique following a printing with color ink, whereby color ink is dried to some extent before the black-ink printing to avoid the mixing or bleeding of the black ink and color ink.

In this technique, although the bleeding is reduced due to the arrangement of the color ink nozzles and the black ink nozzle, the time length for printing is increased and the printing head has a larger scale. In addition, the number of nozzles formed in the printing head is limited, which reduces resolution.

SUMMARY OF THE INVENTION

It is therefore an object of the present invention to provide an ink-jet printer capable of improving the printing quality of the ink-jet printer by reducing blotting, bleeding or mixing of inks and by reducing a paper damage.

It is another object of the present invention to provide a method used in an ink-jet printer.

The present invention provides an ink-jet printer comprising a plurality of pressure chambers each for receiving therein ink, a piezoelectric element having a plurality of separate electrodes each for responding to a driving pulse to eject the ink from a corresponding one of the pressure chambers, the piezoelectric element forming an ink dot on a recording sheet (printing media) based on the driving pulse, a mode selection section for selecting one of a plurality of printing modes, a driving signal generator for generating at least one waveform for the driving pulse based on the selected one of the printing modes, and a driving section for supplying the driving pulse to each of the separate electrodes based on the selected waveform.

In accordance with the ink-jet printer of the present invention, the amount of ejected ink can be selected for each ink dot by selecting the waveform of the driving pulse based on the selected printing mode such as in accordance with the type of the recording sheet, resolution or printing speed. Thus, bleeding or mixing of ink can be reduced as well as the paper damage, whereby an excellent printing quality can be obtained.

The term "ink-jet printer" as used herein means an ordinary ink-jet printer used for a computer, for example, as well as an ink-jet recording device such as a facsimile or copying machine, so long as the recording device uses an ink-jet printing technique therein.

The present invention also provides a method for printing an image on a recording sheet (printing media) comprising the steps of specifying a printing mode out of a plurality of printing modes, selecting at least one waveform out of a plurality of waveforms based on the specified printing mode, and driving a piezoelectric element based on the selected waveform.

In accordance with the method of the present invention, since the driving pulse can be controlled based on printing mode such as in accordance with the type of the recording sheet, resolution or printing speed, deficiencies such as blotting, bleeding or mixing of ink can be reduced on either a plain paper or a dedicated printing sheet.

The above and other objects, features and advantages of the present invention will be more apparent from the following description, referring to the accompanying drawings.

PREFERRED EMBODIMENTS OF THE INVENTION

Now, the present invention is more specifically described with reference to accompanying drawings.

Figure 1:
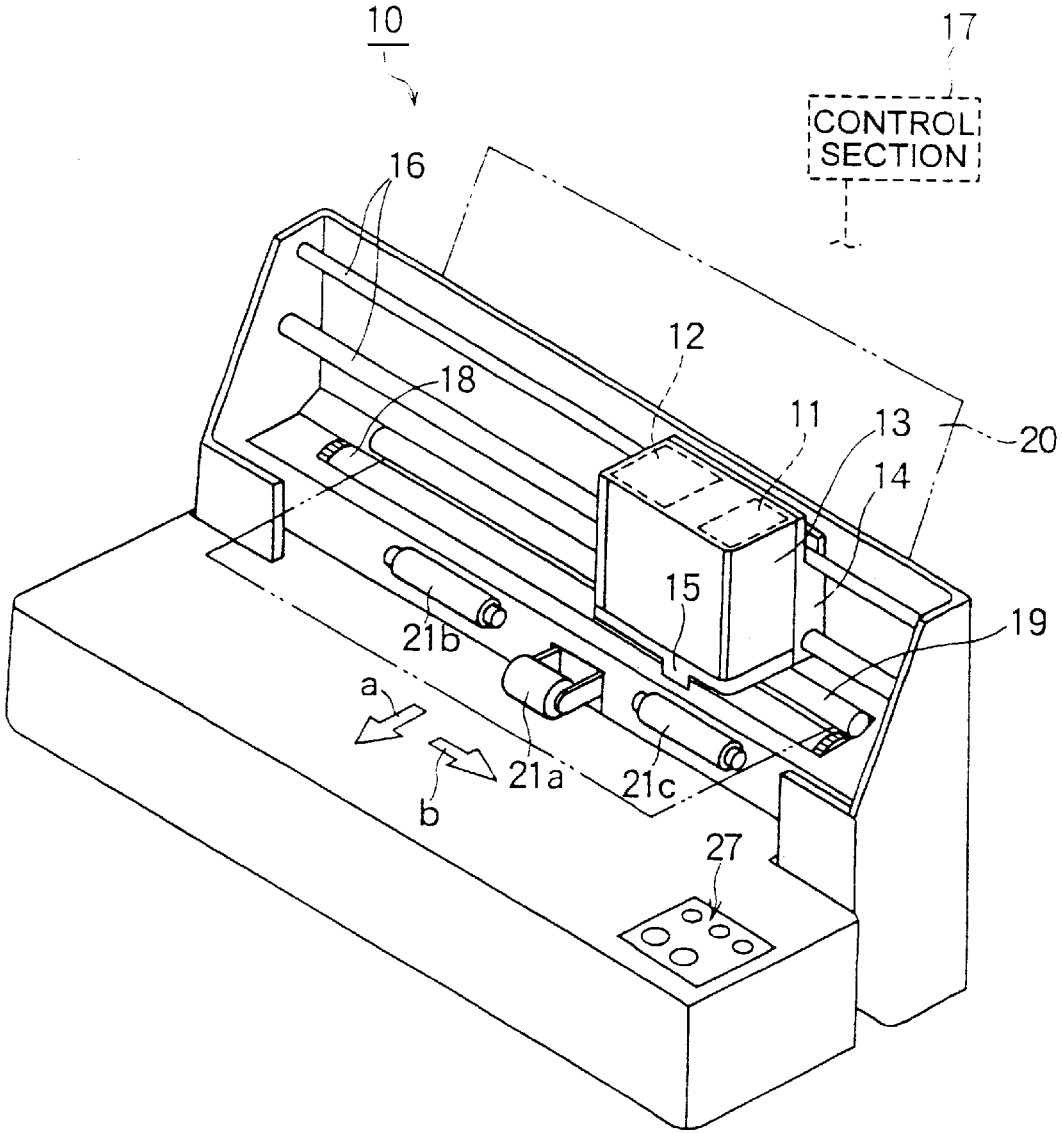
FIG. 1 is a perspective view of an ink-jet printer according to an embodiment of the present invention.

Referring to FIG. 1, an ink-jet printer, generally designated by numeral 10, according to an embodiment of the present invention includes a printer body 29 including a casing, a pair of guide shafts 16 extending in a transverse direction of the printer body 29, a recording head 15 including a head carriage 14 and a plurality of nozzle assemblies (not shown) and driven by a motor (not shown) along the guide shafts 16, and a control section 17 for controlling overall operation of the printer 10.

The printer body 29 includes a pair of feed rollers 18 and 19 which operate in synchrony with the head carriage 14 for feeding a recording sheet (printing media) 20 in a direction of arrow "a" by a specified distance in an intermittent operation.

In front of the feed rollers 18 and 19, a set of discharge rollers 21*a*, 21*b* and 21*c* are provided for supporting the rear side of the recording sheet 20. A switch board or panel 27 mounting thereon button switches is disposed in a front corner of the printer body 29 for specifying one of a plurality of printing modes of the printer 10.

The head carriage 14 includes a holder 13 for receiving therein a black cartridge 11 used for printing monochrome characters and a plurality of color cartridges 12 used for printing color images. The black cartridge 11 receives therein a black ink (B), whereas each of the color cartridges 12 separately receives therein yellow (Y), magenta (M) or cyan blue (C) ink.

The black ink is supplied from the black cartridge 11 through a common ink pool to fill a plurality of pressure chambers. When an ejection energy is applied from a piezoelectric element to the black ink in the pressure chamber, the black ink is ejected from ink nozzles, each disposed for a corresponding one of the pressure chambers, toward the recording sheet for printing ink dots thereon. Each color ink is supplied from the color cartridge 12 through a common ink pool to a plurality of pressure chambers. When an ejection energy is applied to the color ink received in the pressure chambers, the color ink is ejected from ink nozzles each disposed for a corresponding one of the pressure chambers toward the recording sheet 20 for printing ink dots thereon.

Figure 2:
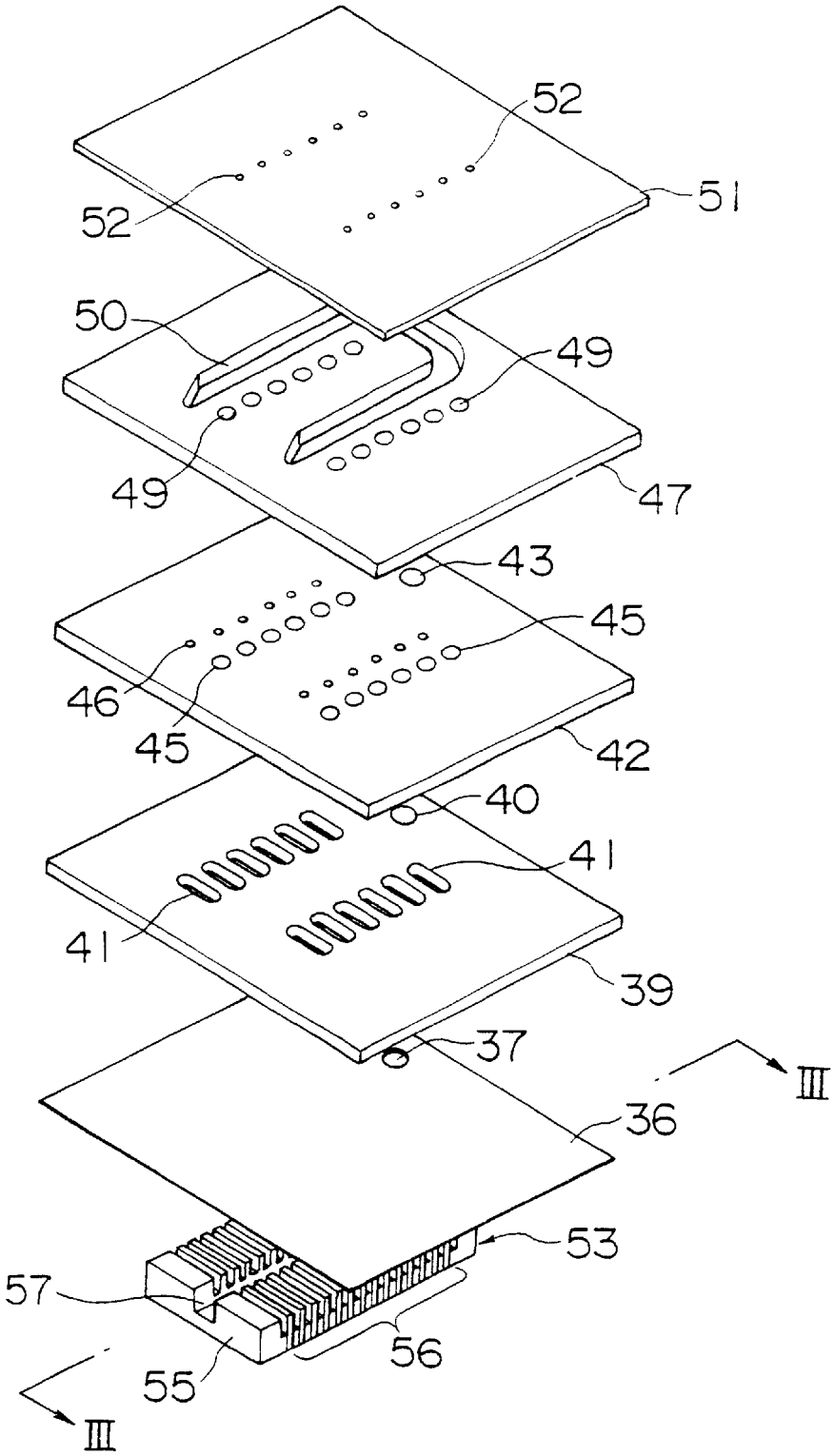
FIG. 2 is an exploded perspective view of a nozzle portion of the recording head in the ink-jet printer shown in FIG. 1.

Referring to FIG. 2, there is shown a configuration of the nozzle assembly disposed in the recording head 15 shown in FIG. 1, which configuration is common to the nozzle assemblies for the black ink and all the color inks. The nozzle assembly includes a piezoelectric element 53 having a central trench 57 extending in the longitudinal direction of the piezoelectric element 53 and a plurality of transverse trenches 58 extending perpendicular to the central trench 57 and in parallel to one another. The piezoelectric element 53 has a plurality of separate electrodes 56 each disposed between adjacent transverse trenches 58, and a common electrode 55 having a plurality of branches each disposed for opposing each separate electrode 56. The nozzle assembly also includes a vibration plate 36, a pressure plate 39, a supply plate 42, a pool plate 47 and a discharge plate 51 consecutively disposed on the piezoelectric element 53.

The vibration plate 36 has therein an ink port 37 at an edge portion thereof, and the pressure plate 39 has another ink port 40 communicated with the ink port 37 of the vibration plate 36 and a plurality of pressure chambers 41 formed as through-holes corresponding to the separate electrodes 56. The supply plate 42 has another ink port 43 communicated with the ink port 40 of the pressure plate 39, a plurality of ink passages 45 communicated with the respective pressure chambers 41, and a plurality of supply ports 46 disposed in the vicinity of the respective ink passages 45. The pool plate 47 has a plurality of ink passages 49 disposed for the respective ink passages 45 of the supply plate 42, and a common ink pool 50 of U-shape disposed in the vicinity of the ink passages 49. The discharge plate 51 has a plurality of ink nozzles 52 communicated with the respective ink passages 49.

Figure 3:
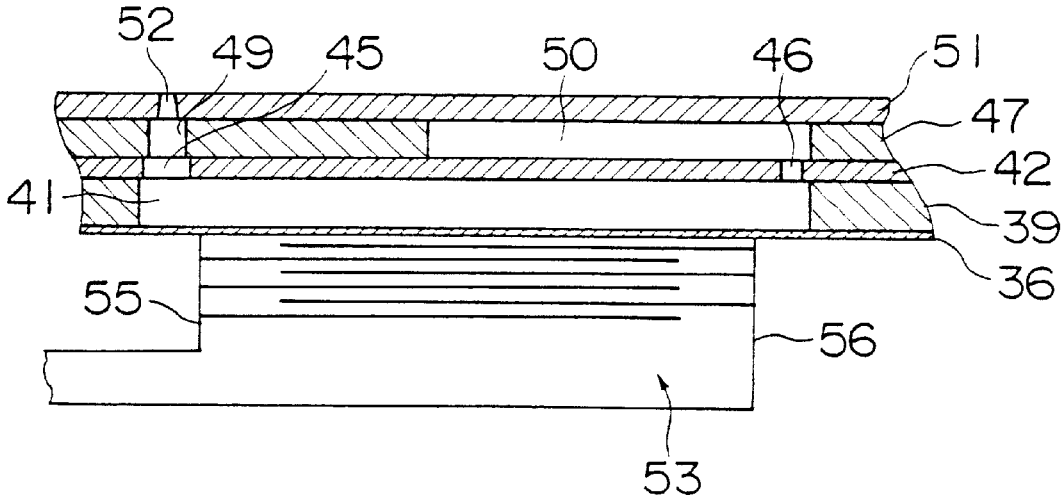
FIG. 3 is a sectional view of the nozzle portion of FIG. 2 taken along line III—III in the final fabrication stage thereof.

Referring to FIG. 3 showing a cross-section taken along line III—III in FIG. 2, in the nozzle assembly, the piezoelectric element 53 has a plurality of layers of separate electrode 56 opposing respective layers of the branch of the common electrode 55 in a stacked structure. Above the layers of the electrodes 55 and 56, the vibration plate 36, the pressure plate 39, the supply plate 42, the pool plate 47 and the discharge plate 51 are consecutively stacked for communication of the pressure chamber 41 with the ink pool 50 through the supply port 46, and communication of the pressure chamber 41 with the ink nozzle 52 through the ink passages 45 and 49. These plates are adhered to one another by an adhesive. As shown in the figure, the cross-section of the ink passages 45 and 49 is reduced as viewed from the pressure chamber 41 toward the ink nozzle 52.

In this configuration, each ink is supplied to the ink pool 50 from a corresponding one of the ink cartridges 11 and 12, and then supplied to the pressure chambers 41 and to the ink nozzles 52 by the function of the piezoelectric element 53 driven by a driving pulse supplied to the separate electrodes 56.

Figure 4:
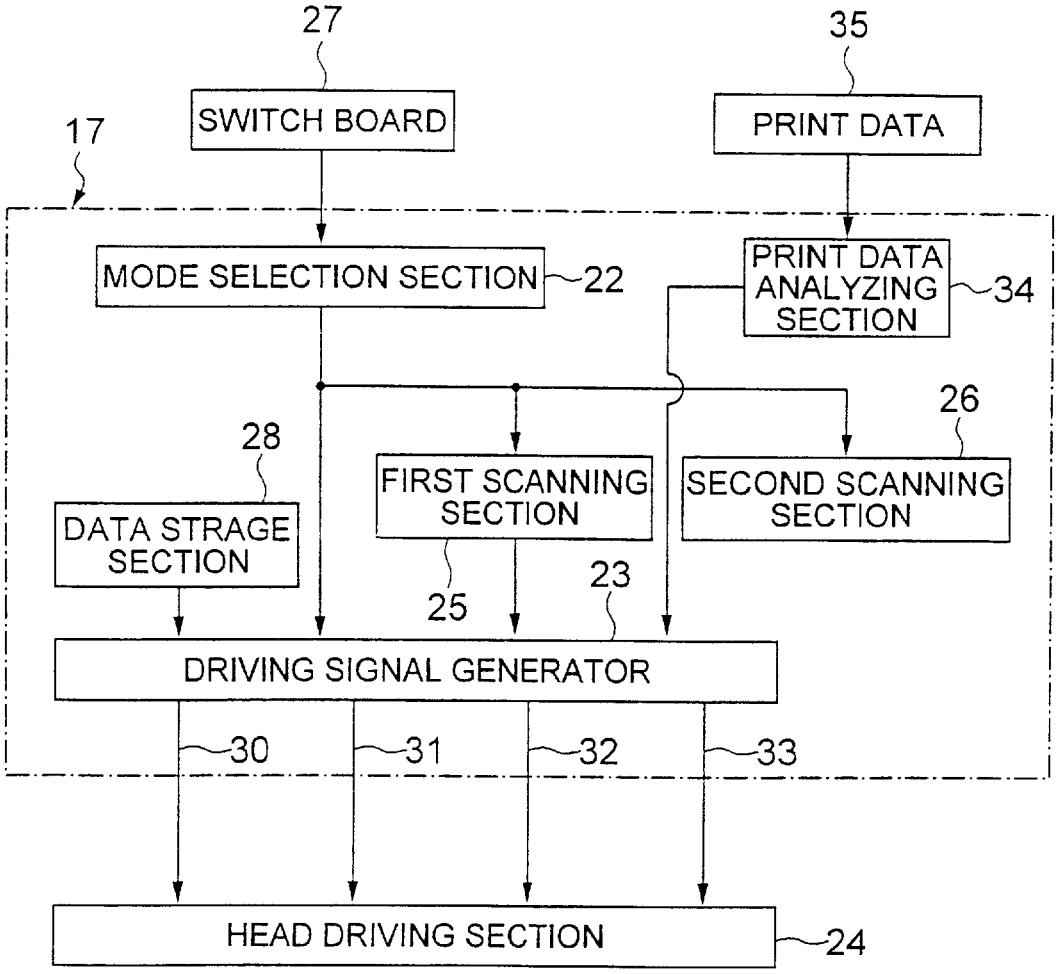
FIG. 4 is a block diagram of the control section of the ink-jet printer of FIG. 1.

Referring to FIG. 4, the control section 17 of the ink-jet printer 10 of FIG. 1 includes a mode selection section 22, a data storage section 28, a driving signal generator 23, a main (first) scanning section 25, a subordinate (second) scanning section 26, and a print data analyzing section 34.

The mode selection section 22 receives an input signal from the switch board 27 to select one of a plurality of modes based on the characteristics of the type of the recording sheet 20 and the desired printing quality as to a resolution or a printing speed.

The data storage section 28 stores a plurality (n=3, in this embodiment) of waveforms for the driving pulse, one or two out of which is selected based on an output from the mode selection section 22.

The driving signal generator 23 selects "m" of the "n" waveforms (n>m) for the driving pulse stored in the data storage section 28 based on the mode selected by the mode selection section 22. In this embodiment, the number "m" is selected at m=2. The number "n" of the waveforms for the driving pulse corresponds to the number of different dot diameters of the printed ink dots which include a larger dot diameter corresponding to $\sqrt{2}$ of a standard dot pitch used for the standard resolution, a medium dot diameter corresponding to the standard dot pitch, and a smaller dot pitch corresponding to $1/\sqrt{2}$ d of the standard dot pitch.

The first scanning section 25 generates a first timing signal for driving the piezoelectric element in synchrony with the movement of the head carriage 14 in the direction "b" in FIG. 1, and supplies the first timing signal to the driving signal generator 23. The second scanning section 26 generates a second timing signal for controlling the transfer of the recording sheet in the direction "a" in FIG. 1.

The print data analyzing section 34 judges input print data 35 as to whether or not a specified ink dot has another ink dot at each of the top, bottom, left and right sides of the specified ink dot. The print data analyzing section 34 supplies the input print data together with an instruction for specifying the size of the ink dot to the driving signal generator 23 based on the result of the judgement. The print data analyzing section 34 specifies four windows at the top, bottom, left and right sides of the specified dot for determining the presence of other ink dots therein. The print data analyzing section 34 also determines that the print data is directed to a character (or monochrome data) if the print data includes black data in the four windows. The print data analyzing section 34 supplies an instruction to the driving signal generator 23 for reducing the dot diameter of the specified ink dot if the specified ink dot has four adjacent ink dots provided that the print data is directed to a character data.

The driving signal generator 23 selects two waveforms out of three waveforms for the driving pulse stored in the data storage section 28 based on the mode specified by the mode selection section 22, and also receives the timing signal supplied from the first scanning section 25, and the result of analysis supplied from the print data analyzing section 34. The driving signal generator 23 generates, based on the selected waveforms and received signals, an offset voltage 30, discharge pulses 31 and 33 and a charge pulse 32, and supplies the same to a head driving section 24 for driving the recording head 15.

The driving signal generator 23 selects two waveforms out of three waveforms for the driving pulse which provide more amount of ink for an ink droplet if the current recording sheet is a dedicated printing sheet which involves less bleeding compared to a plain paper. The driving signal generator 23 also selects two waveforms out of three waveforms which provide less amount of ink for an ink droplet if the current recording sheet is a plain paper.

The head driving section 24 supplies driving voltage pulses to the separate electrodes 56 to drive the piezoelectric element 53 for printing based on the two waveforms of the driving pulse, which are regenerated based on the offset voltage 30, discharge pulses 31 and 33, and a charge pulse 32 supplied from the driving signal generator 23.

Figure 5:
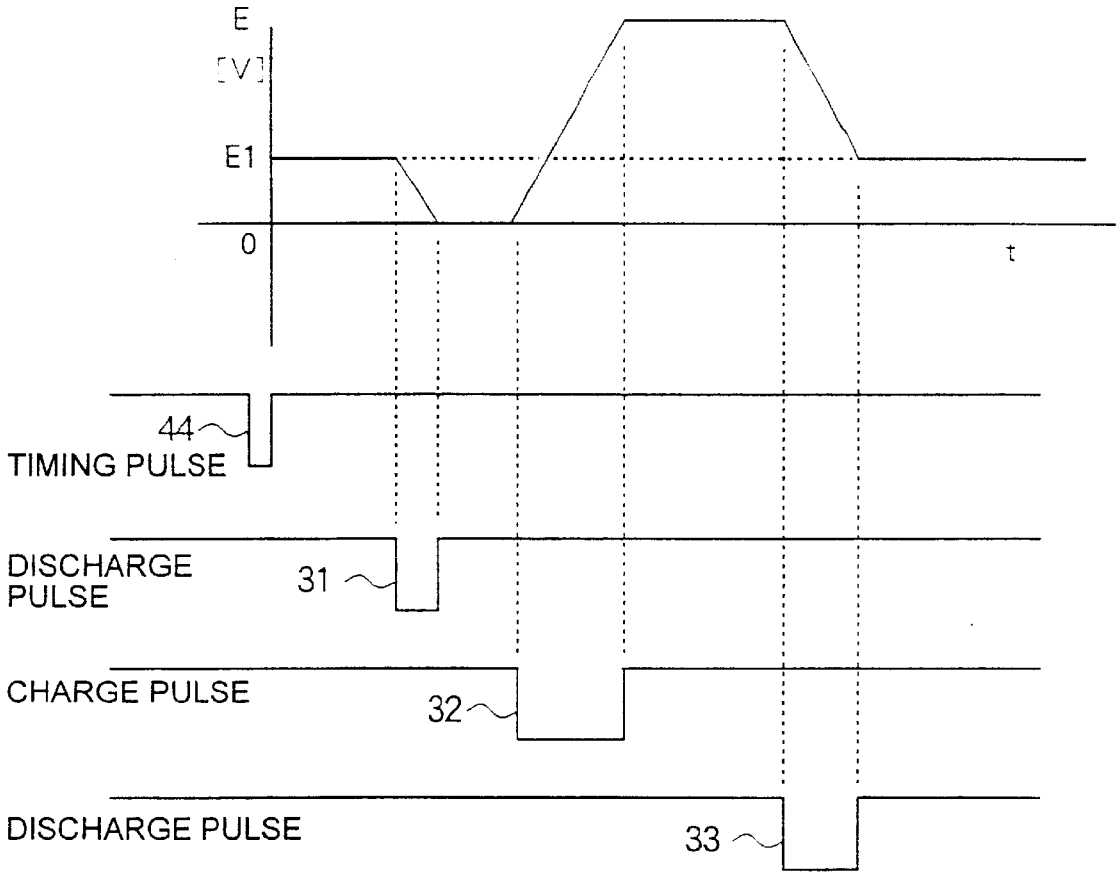
FIG. 5 is a timing chart for showing a driving signal for generating a larger dot diameter in the ink-jet printer of FIG. 1.
Figure 6:
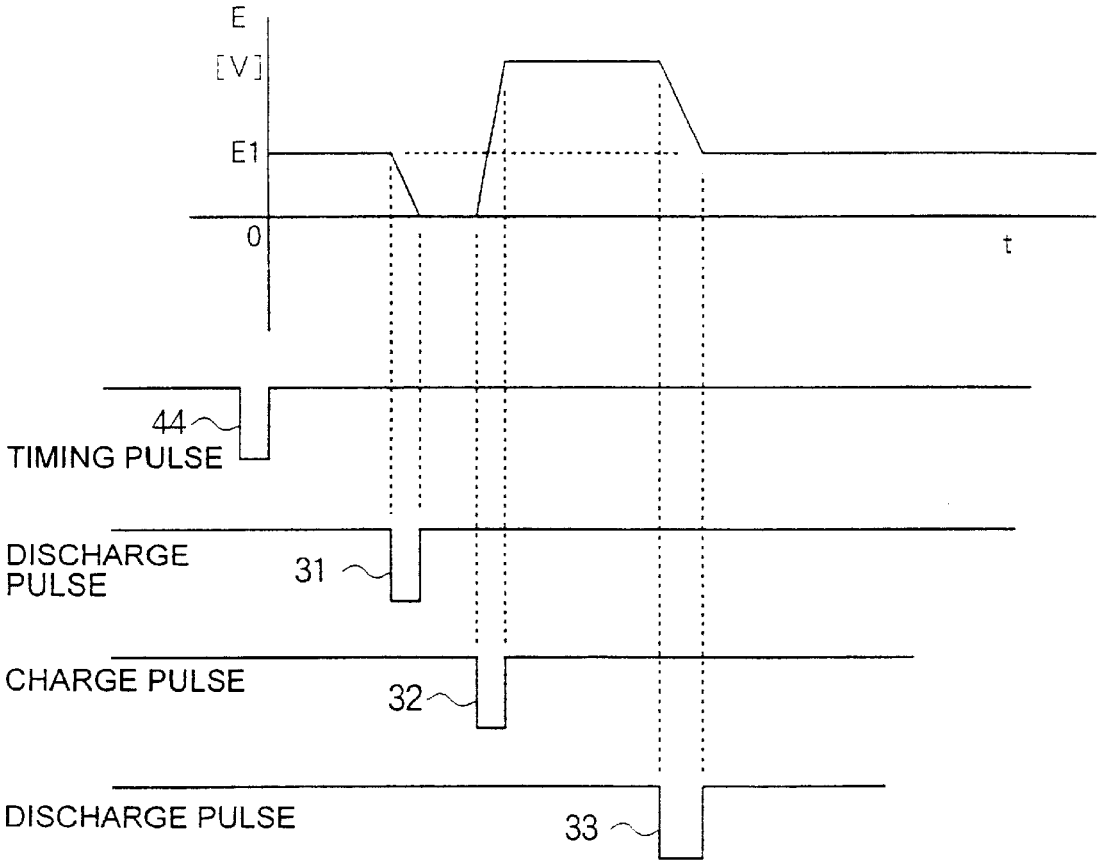
FIG. 6 is a timing chart for showing a driving signal for generating a medium dot diameter in the ink-jet printer of FIG. 1.
Figure 7:
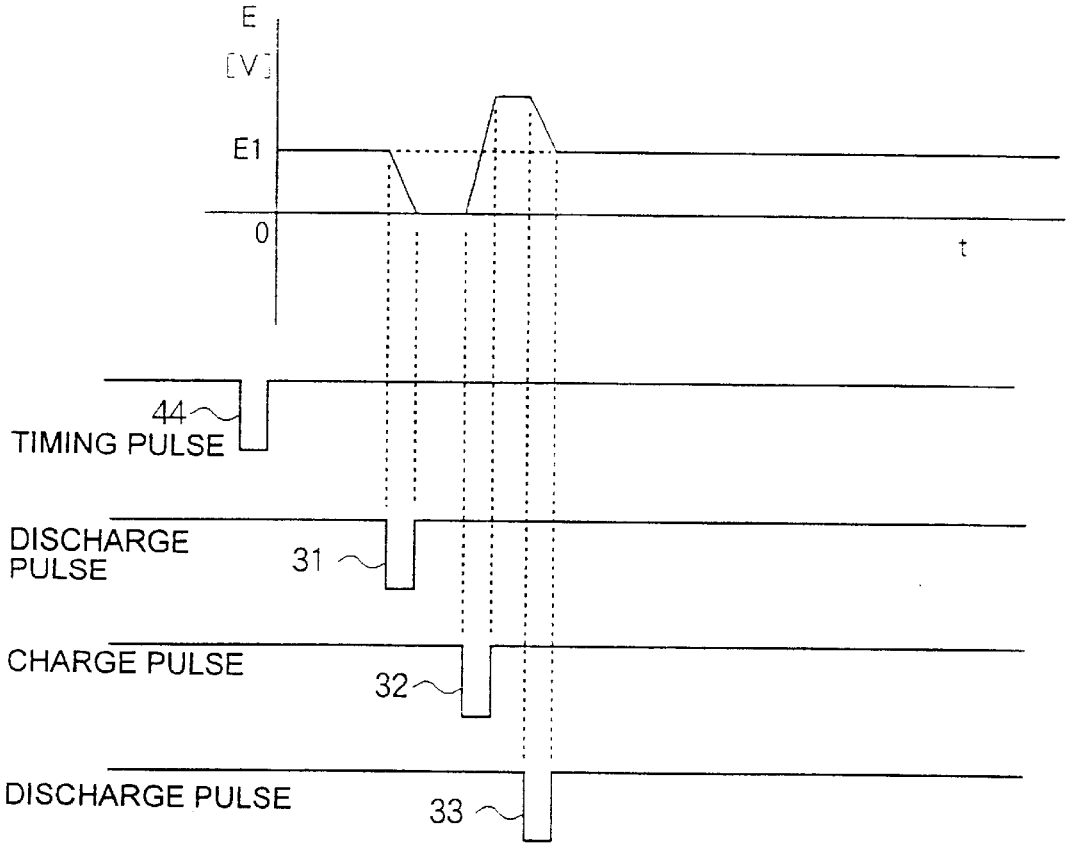
FIG. 7 is a timing chart for showing a driving signal for generating a smaller dot diameter in the ink-jet printer of FIG. 1.

FIGS. 5 to 7 depict waveforms for the driving pulse used in the present embodiment for printing ink dots having a larger dot diameter, a medium dot diameter and a smaller dot diameter, respectively.

In those drawings, El is the voltage level of the offset voltage 30, and the voltage (in volt) of the driving pulse "E" is plotted against time axis "t" in association with the timing pulse 44, discharge pulse 31, charge pulse 32 and discharge pulse 33. As will be understood by these drawings, the driving pulse has a first duration, or offset duration, during which drive pulse assumes the offset voltage level (E1) and a subsequent driving duration during which the driving pulses have different voltage levels. The time lengths of the offset duration and the driving duration as well as the voltage level during the driving duration are determined by the timings and the time lengths of the timing pulse 31, discharge pulses 31 and 33, and the charge pulse 32.

More specifically, a smaller time length of the first discharge pulse 31 provides moderate decrease of the offset voltage for the driving pulse for a large dot diameter, large time lengths of the charge pulse 32 and the second discharge pulse 33 provide a higher voltage for the driving duration for a larger dot diameter. In addition, a smaller time interval between the charge pulse 32 and the second discharge pulse 33 provides a smaller time length for a smaller dot diameter.

Figure 8:
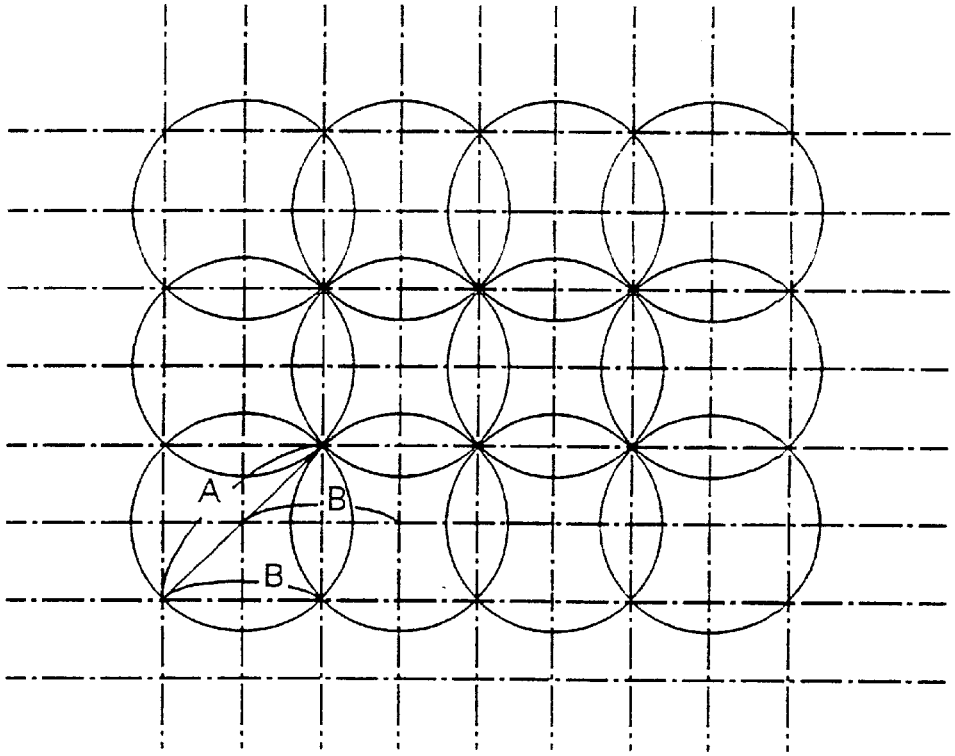
FIGS. 8 to 12 are schematic top plan views of different patterns of ink dots each obtained by a conventional ink-jet printer.

FIGS. 8 to 12 show dot patterns printed by conventional ink-jet printers. In FIG. 8, the dot pattern is formed by ink dots having a larger dot diameter, which is larger than the distance between the centers of adjacent ink dots. More specifically, the dot diameter "A" is $\sqrt{2}$ of the distance "B" between the centers of the adjacent ink dots in this case. The distance "B" is called herein a standard dot pitch, which is used for a standard resolution in the printer. This dot pattern provides a configuration of uniform printing wherein all the printing area can be filled with the ink dots.

Figure 9:
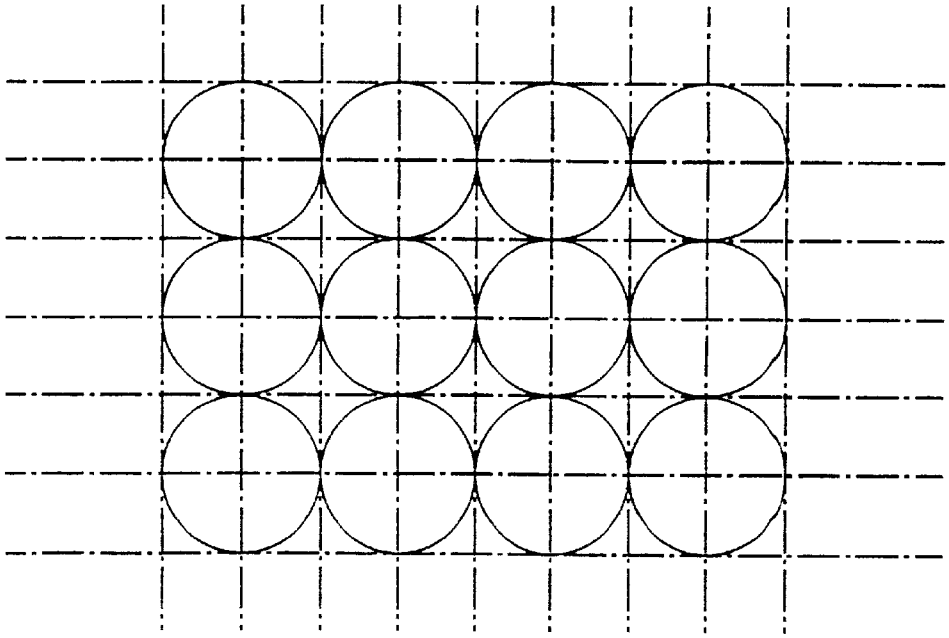
Figure 10:
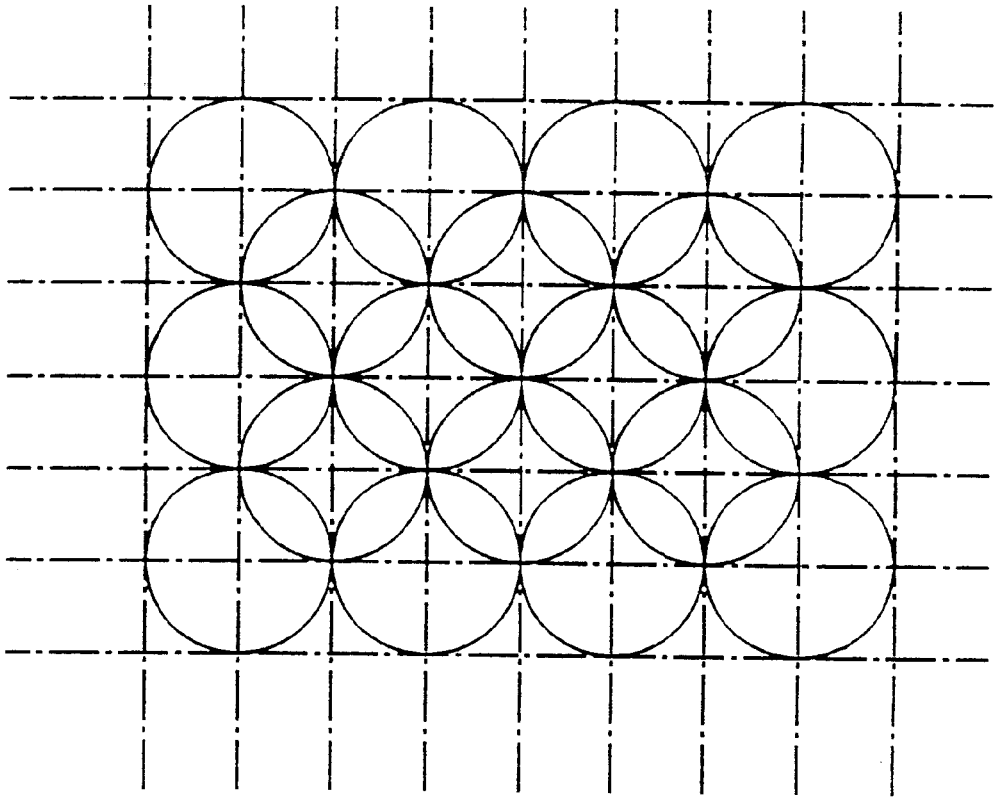

In FIG. 9, the dot pattern is formed by ink dots having a medium dot diameter, which is substantially same as the distance between the centers of adjacent ink dots. This dot pattern cannot provide a configuration of uniform printing wherein all the printing area is filled with the ink dots. However, if the printing is conducted with a dot pitch which is twice the standard dot pitch in both the row and column directions, a uniform printing can be obtained wherein all the printing area is filled with the ink dots, as shown in FIG. 10.

Figure 11:
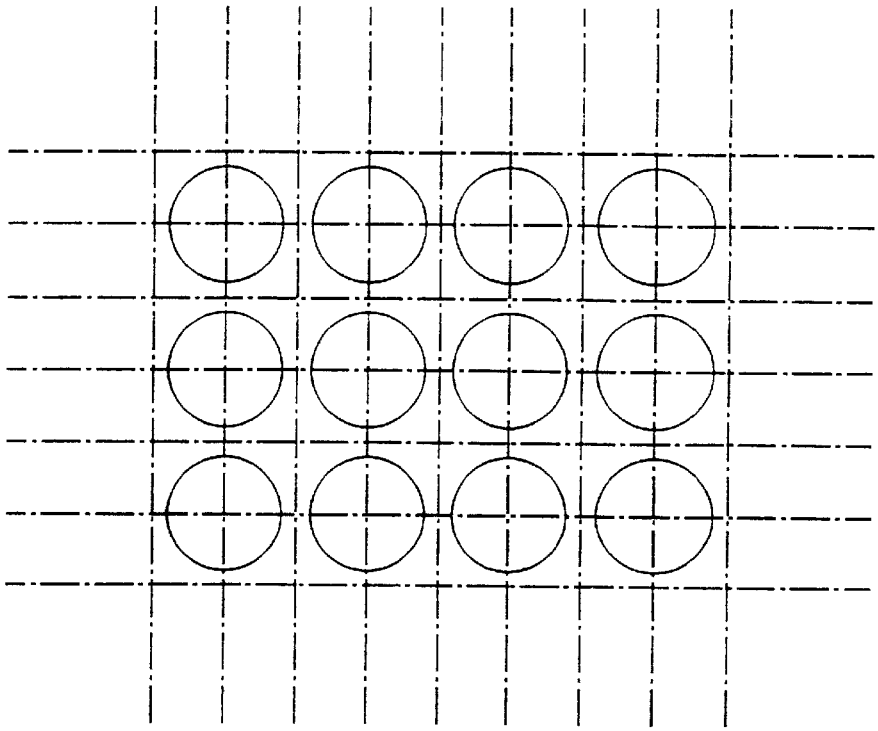
Figure 12:
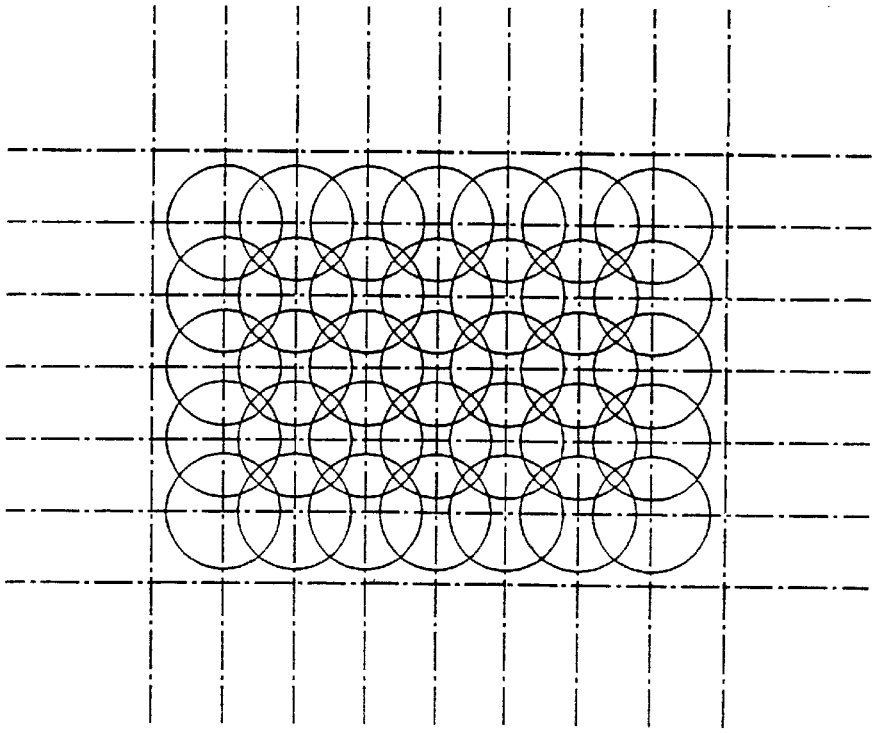

In FIG. 11, the dot pattern is formed by ink dots having a smaller dot diameter, which is smaller than the distance between the centers of adjacent ink dots. Specifically, the dot diameter is $1/\sqrt{2}$ of the standard dot pitch. This dot pattern cannot provide a configuration of uniform printing wherein all the printing area is filled with the ink dots. However, if the printing is conducted with a dot pitch which is twice the standard dot pitch in both the row and column directions, a uniform printing can be obtained wherein all the printing area is filled with the ink dots, as shown in FIG. 12.

Figure 13:
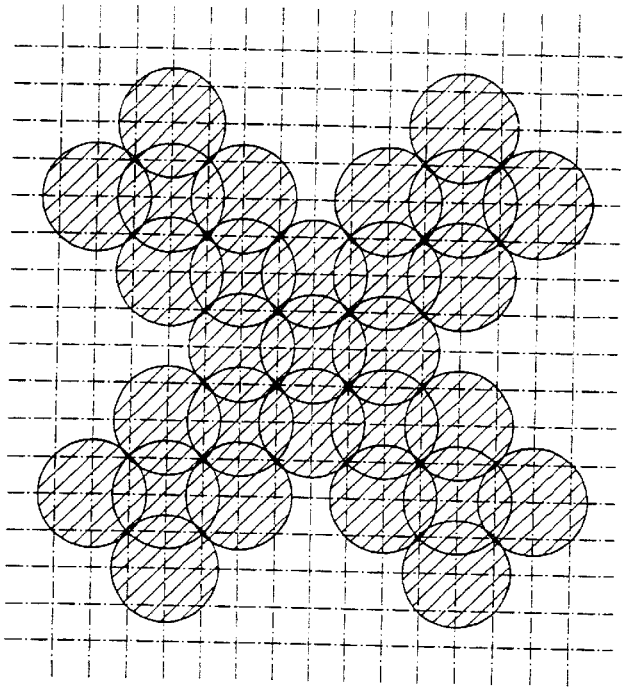
FIG. 13 is a schematic top plan view of a dot pattern obtained by ink dots having a larger dot diameter.
Figure 14:
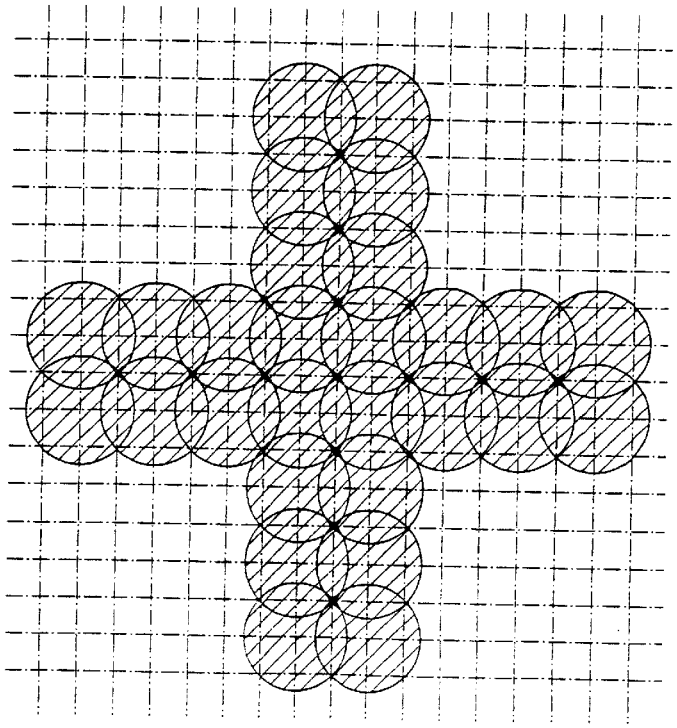
FIG. 14 is another schematic top plan view of a dot pattern obtained by ink dots having a larger dot diameter.

Referring to FIGS. 13 and 14, there are shown different dot patterns obtained by ink dots having a larger dot diameter, which is $1/\sqrt{2}$ of the standard dot pitch. In these figures, uniform printing can be obtained wherein all the printing area is filled with the ink dots.

Figure 15:
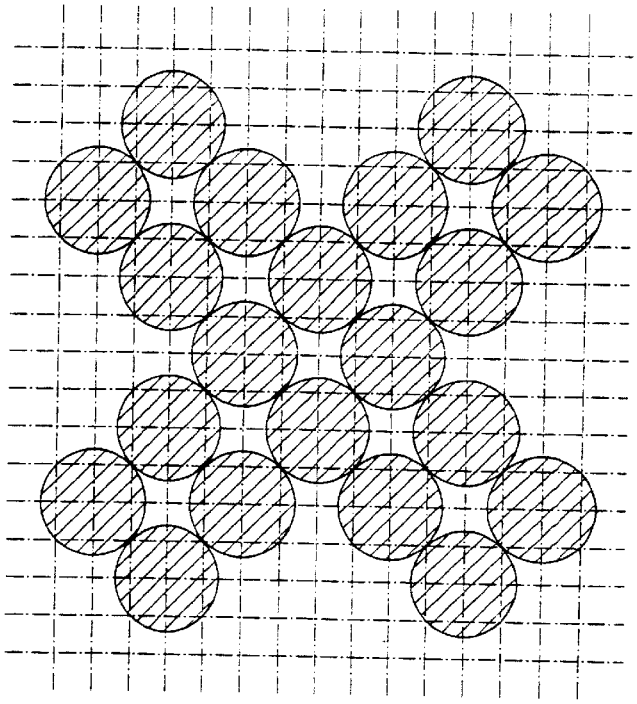
FIG. 15 is another schematic top plan view of a dot pattern obtained by a thinning out printing technique using ink dots having a larger dot diameter.

FIG. 15 shows a dot pattern corresponding to the dot pattern shown in FIG. 13, although the printing itself is conducted in FIG. 15 by a thinning out printing technique using the larger dot diameter. In this dot pattern, a uniform printing cannot be obtained, which causes a blank area or reduction of ink density in the dot pattern.

Figure 16:
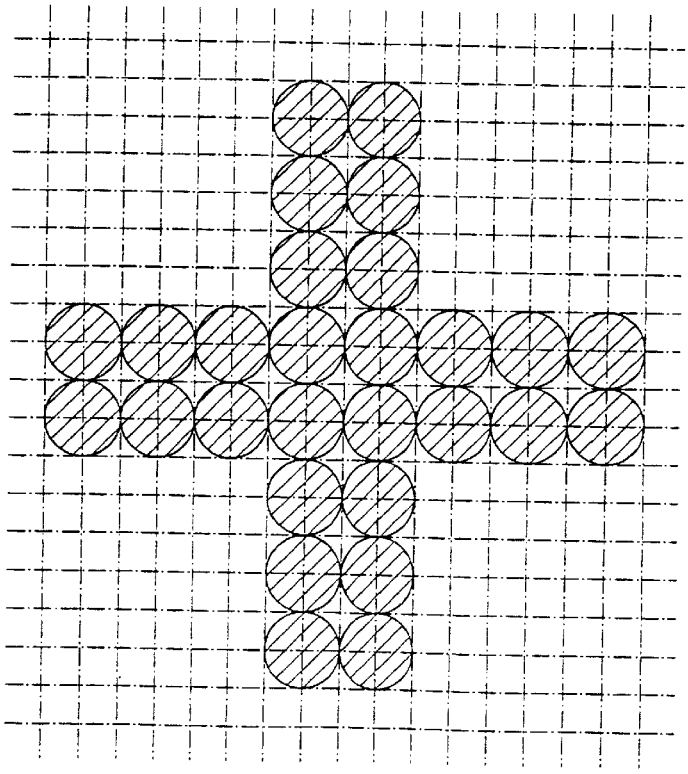
FIG. 16 is another schematic top plan view of a dot pattern obtained by a thinning out printing technique using ink dots having a medium dot diameter.

FIG. 16 shows a dot pattern corresponding to the dot pattern shown in FIG. 14, although the printing is conducted in FIG. 16 by using ink dots having a medium dot diameter which is substantially equal to the standard dot pitch. In this example, a uniform printing cannot be obtained.

In the examples as described above for conventional techniques, each of the dot patterns includes ink dots having a uniform dot diameter, which means that a single waveform for the driving pulse is used for the printing. In the conventional technique, there is a problem that bleeding or mixing of ink degrades the printing quality. The present inventor noticed that different recording sheets have respective characteristics for the bleeding or mixing of ink. That is, it is noticed that the printing quality can be improved, if the control of the dot diameter is conducted in association with the characteristics of the recording sheet as well as the density of the ink dots, as detailed below.

Figure 17A:
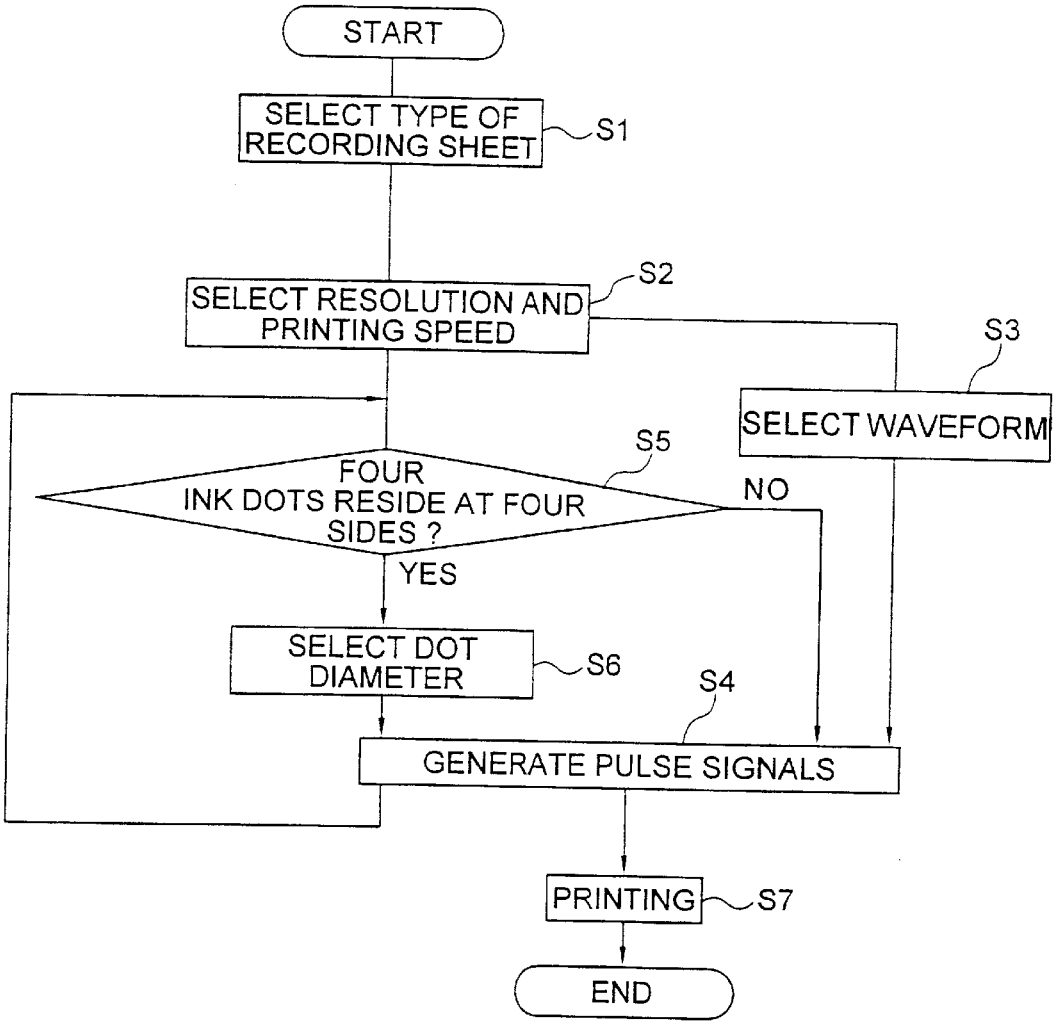
FIG. 17A is a flowchart of monochrome printing according to the embodiment.

Referring to FIG. 17A, there is shown a flowchart for a monochrome printing operation conducted in the ink-jet printer of the present embodiment. After the printer is turned on, the user selects one of the types of the recording sheet, a resolution and a printing speed at the switch board 27 in step S1 and S2, whereby the mode selection section 22 selects one of the printing modes based on the inputs from the switch board 27. The mode selection section 22 informs the selected printing mode to the driving signal generator 23. The driving signal generator 23 retrieves two waveforms out of three waveforms for the driving pulse in the data storage section 28 based on the selected printing mode in step S3, and generates pulse signals based on the selected waveforms in step S4, and delivers the same to the head driving section 24.

Figure 17B:
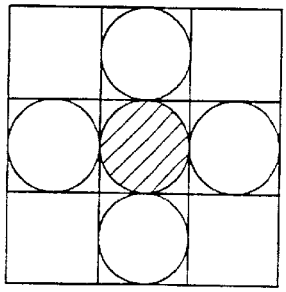
FIG. 17B is a schematic top plan view of the dot pattern used for judgement in the process shown in FIG. 17A.

In step S5, the print data analyzing section 34 analyzes the input print data to judge whether or not all the four ink dots exist adjacent to a specified ink dot at the top, bottom, left and right of the specified ink dot 59, as shown by four blank circles 60 adjacent to the specified dot pattern 59 in FIG. 17B. If it is judged in step S5 that all the four ink dots exist adjacent to the specified ink dot 59 in the print data, information for a dot diameter of the specified ink dot 59 and another dot diameter of the four ink dots are supplied to the driving signal generator 23 in step S6. If the print data analyzing section 34 judges in step S5 that all the four ink dots do not exist in the print data, the print data analyzing section 34 informs the driving signal generator 23 in step S6 that the specified ink dot should be printed with a dot diameter same as the dot diameter of the four ink dots.

The pint data is analyzed as to the presence of four ink dots, with each of all the ink dots in the print data being the specified ink dot 59 shown in FIG. 17B. The driving signal generator 23 supplies the pulse signals for the waveforms of the driving pulse to the head driving section 24, which executes printing based on the waveforms in step S7.

Figure 18:
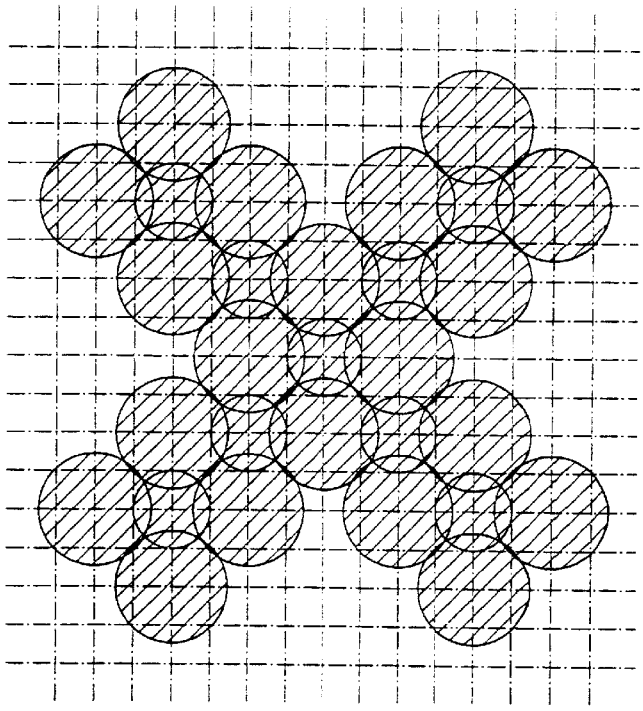
FIGS. 18 to 20 are top plan views of dot patterns obtained by the first embodiment.
Figure 19:
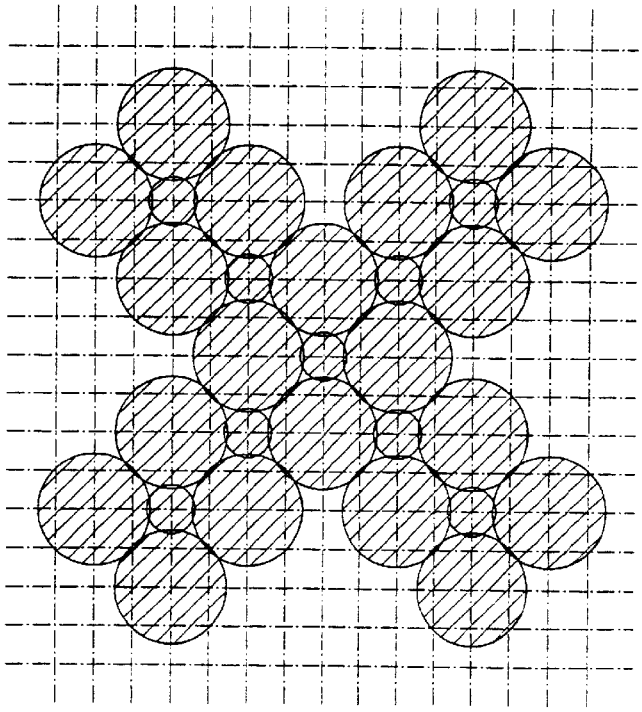
Figure 20:
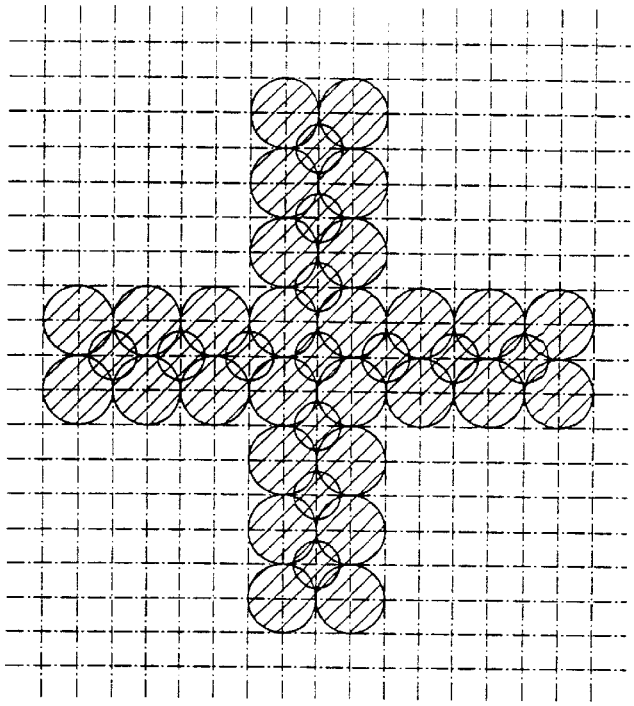

FIGS. 18 to 20 show examples of the dot pattern obtained by the process of FIG. 17A, wherein bleeding of ink can be reduced. In FIG. 18, the depicted dot pattern is obtained by using ink dots having a larger dot diameter except for specified ink dots 59 each having adjacent ink dots at the four sides thereof, the specified ink dots 59 having a medium dot diameter. This particular dot pattern is not for a gray scale level printing. In this example, bleeding of ink can be reduced compared to the dot pattern formed by ink dots having a uniform, larger dot diameter. Since there are some overlapping portions of the ink dots, the dot pattern is formed on a dedicated printing sheet, which has relatively less bleeding.

In FIG. 19, the depicted dot pattern is similar to the dot pattern shown in FIG. 18 except that the specified ink dots 61 each having four adjacent ink dots have a smaller dot diameter. This particular configuration is not for the gray scale level printing. The dot pattern having a combination of the larger dot diameter and the smaller dot diameter does not substantially involve overlapping portions of the ink dots. Thus, the dot pattern is formed on a plain paper, which has relatively more bleeding.

In FIG. 20, the depicted dot pattern is obtained by using ink dots having a medium dot diameter except for specified ink dots 62 having adjacent ink dots at the four sides, the specified ink dots 62 having a smaller dot diameter. This particular dot pattern is not for the gray scale level printing. In this example, the dot pattern involves less bleeding compared to the dot pattern formed by ink dots having a uniform, medium dot diameter.

Figure 21:
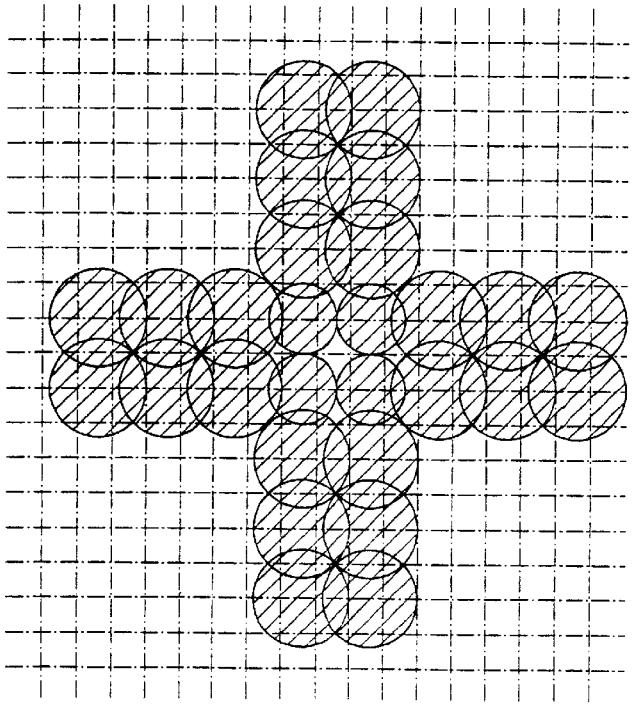
FIG. 21 is a top plan view of dot patterns obtained by modification from the process of FIG. 17A.

FIG. 21 shows a dot pattern obtained by a modification of the process of FIG. 17A. In this modification, the dot pattern is formed by two crossing lines of ink dots having a larger dot diameter except for the specified ink dots 63 located at the cross point of the two lines and having a medium dot diameter. Alternatively, if the crossing lines are formed by ink dots having a medium dot diameter, the specified ink dots 63 located at the cross point may have a smaller dot diameter. The depicted configuration provides prevention of bleeding of ink, which is generally attributable to the ink dots having a uniform dot diameter.

Figure 22A:
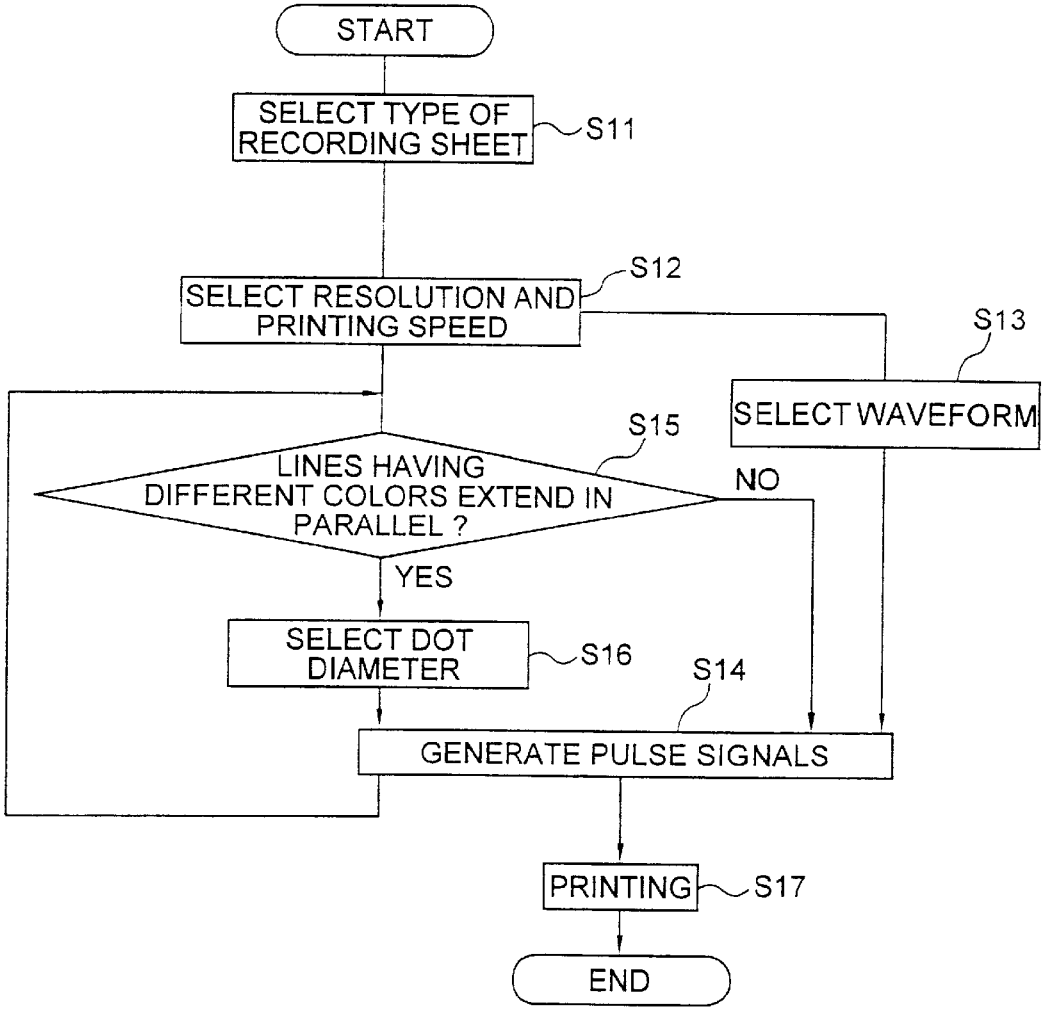
FIG. 22A is a flowchart of color printing according to the embodiment.
Figure 22B:
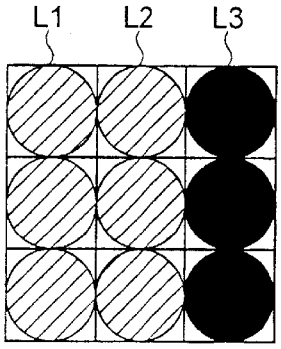
FIG. 22B is a schematic top plan view of the dot pattern used for judgement in the process shown in FIG. 22A.

FIG. 22A shows a flowchart for color printing in the ink-jet printer of the present embodiment. In the ink-jet printer of the present embodiment, the input print data including color data is analyzed to determine the waveforms of the driving pulse after the printing mode is selected by specifying the type of the recording sheet or selecting a resolution and the printing speed. The analysis of the print data is directed to a dot matrix 64 including 3×3 ink dots, such as shown in FIG. 22B. The analysis includes judgement as to whether or not a line L1 or L2 formed by three ink dots having a single color extends adjacent to a line L3 formed by other three ink dots having another color in the dot matrix 64. If such a line L2 extends in parallel and adjacent to a line L3, this fact is stored in a memory to later change the dot diameter of the ink dots during printing. After all the dot matrixes 64 for the ink dots in the print data are analyzed by the print data analyzing section 34 in FIG. 1, the print data is subjected to processing for printing. The direction of the lines L1, L2 and L3 is not limited to the depicted example shown in FIG. 22B, and these lines may be in a row direction.

In FIG. 22A, before printing for the print data, the type of recording sheet and the printing mode including resolution for the printing and the printing speed are selected by the user in steps S11 and S12 at the switch board 27. The mode selection section 22 selects one of the printing modes based on the inputs from the switch board 27, and delivers the selected printing mode to the driving signal generator 23. Thus, the driving signal generator 23 retrieves waveforms of the driving pulse in step S13 and delivers the waveforms to the head driving section 24.

The print data analyzing section 34 analyzes the input print data in step S15 based on the procedure as described above with reference to FIG. 22B, wherein it is judged whether or not lines of different colors formed by three or more ink dots extend in parallel and adjacent to each other. If such lines extend in parallel and adjacent to each other, it is determined in step S16 that the dot diameter of the ink dots on at least one of such lines is changed to a smaller dot diameter. This instruction is delivered to the driving signal generator 23. On the other hand, if such lines do not exist, it is determined in step S16 to use a single dot diameter, and such an instruction is delivered to the driving signal generator 23.

After all the ink dots are subjected to the analysis, the driving signal generator 23 delivers pulse signals based on the waveforms of the driving pulse to the head driving section 24, which conducts printing by applying driving pulse voltages to the separate electrodes in step S17.

Figure 23:
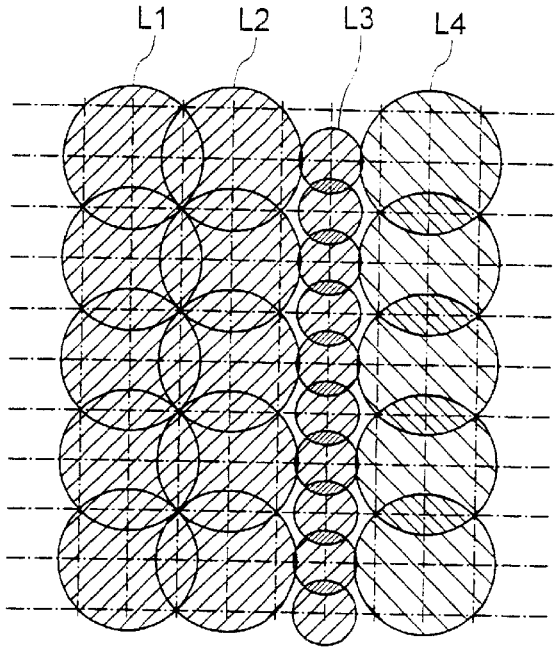
FIGS. 23 to 27 are top plan views of dot patterns obtained by color printing according to the embodiment.
Figure 24:
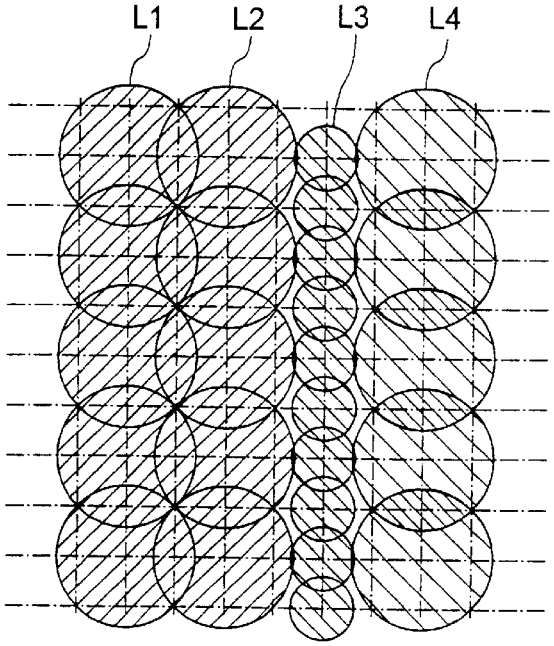

FIGS. 23 to 27 show dot patterns of color ink dots obtained by the ink-jet printer of the present embodiment. In FIG. 23, dot lines L1 to L3 have a common color, whereas dot line L4 has a different color. The depicted dot pattern is formed by color ink dots having a larger dot diameter except for the dot line L3, which extends in parallel and adjacent to the dot line L4 having the different color and has a smaller dot diameter. FIG. 24 is similar to FIG. 23 except for the dot lines L1 and L2 have a common color, whereas the dot lines L3 and L4 have a different color in FIG. 24.

Figure 25:
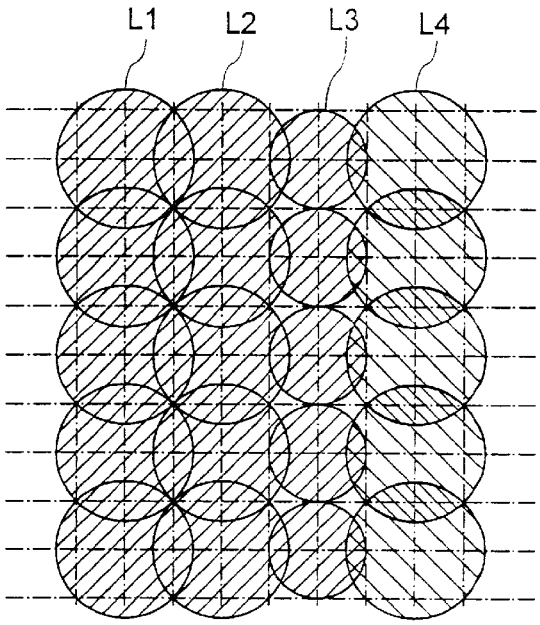
Figure 26:
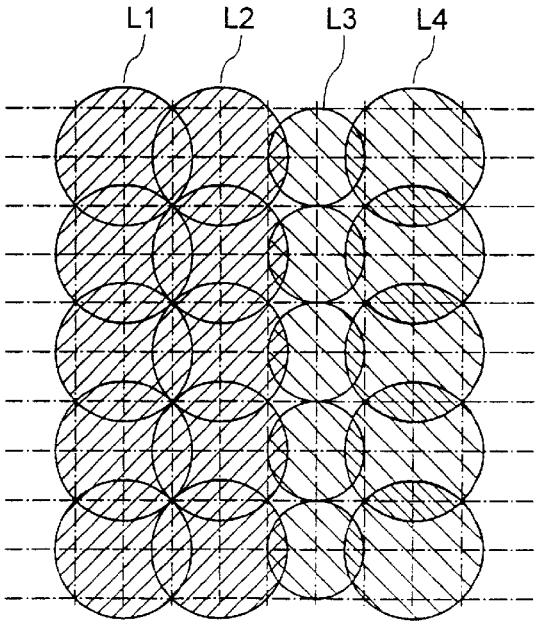

FIG. 25 is similar to FIG. 23 except for the dot line L3 which has ink dots having a medium dot diameter. Similarly, FIG. 26 is similar to FIG. 24 except for the dot line L3 which has ink dots having a medium dot diameter.

Figure 27:
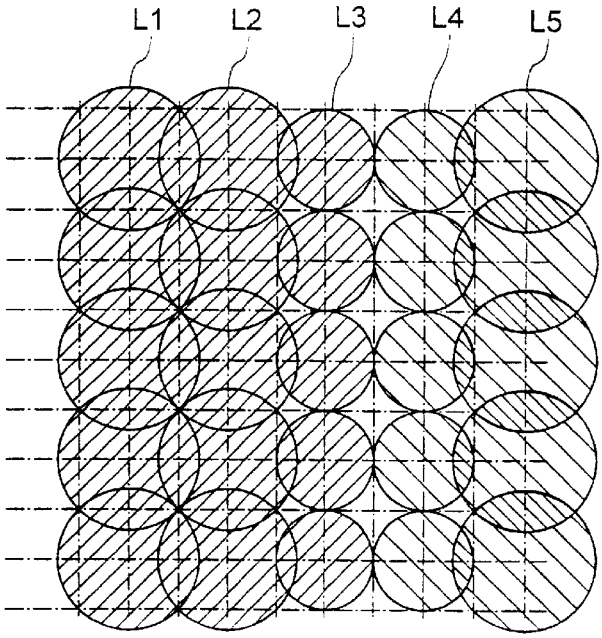
Figure 28:
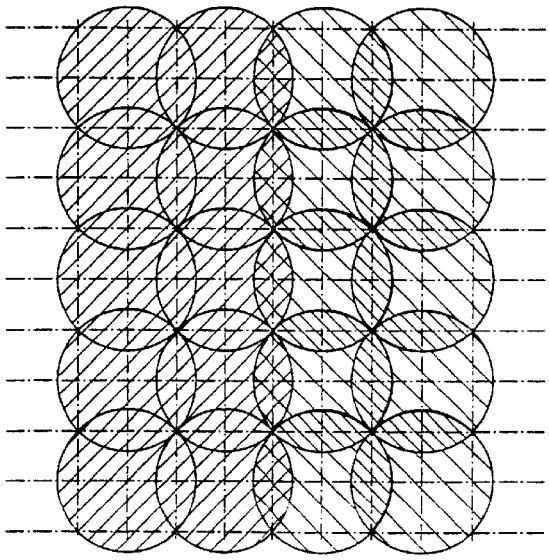
FIG. 28 is a top plan view of a dot pattern obtained by color printing using ink dots having a larger dot diameter.

In FIG. 27, dot lines L1 to L3 have a common color and dot lines L4 and L5 have a different common color. The dot lines L3 and L4 have a medium dot diameter, whereas dot lines L1, L2 and L5 have a larger dot diameter. FIG. 28 shows dot patterns obtained by the conventional technique and is depicted for comparison with the dot patterns obtained by the present embodiment. In FIG. 28, the overlapping portion is liable to involve bleeding of inks and mixing of colors at the boundary between colors.

In the dot patterns as described above, it is preferable that each of the dot diameters falls within ±20% of the target dot diameter.

Since the above embodiments are described only for examples, the present invention is not limited to the above embodiments and various modifications or alterations can be easily made therefrom by those skilled in the art without departing from the scope of the present invention.

What is claimed is:

1. An ink-jet printer comprising a plurality of pressure chambers each for receiving therein ink, a piezoelectric element having a plurality of separate electrodes each for responding to a driving pulse to eject the ink from a corresponding one of said pressure chambers, said piezoelectric element forming an ink dot on a printing media based on said driving pulse, a mode selection section for selecting one of a plurality of printing media, a driving signal generator for generating at least two waveforms for said driving pulse based on said selected one of said printing modes, and a driving section for supplying the driving pulse to each of said separate electrodes based on said selected waveforms.

2. The ink-jet printer as defined in claim 1, further comprising a storage section for storing three or more said waveforms, wherein said driving signal generator generates two of said waveforms by selection out of said three or more waveforms stored in said storage section.

3. The ink-jet printer as defined in claim 2, wherein said three or more waveforms include first to third waveforms used for generating a larger dot diameter, a medium dot diameter and a smaller dot diameter for said ink dot.

4. The ink-jet printer as defined in claim 3, wherein said medium dot diameter is substantially equal to a standard dot pitch.

5. The ink-jet printer as defined in claim 4, wherein said larger dot diameter is substantially equal to $\sqrt{2}$ of said standard dot pitch, and said smaller dot diameter is substantially equal to $1/\sqrt{2}$ of said standard dot pitch.

6. The ink-jet printer as defined in claim 1, further comprising a print data analyzing section for analyzing print data as to whether each ink dot has a plurality of adjacent ink dots in a dot pattern.

7. The ink-jet printer as defined in claim 6, wherein when said print data analyzing section detects a specified ink dot having four adjacent ink dots, and said driving signal generator generates at least two waveforms for said driving pulse.

8. The ink-jet printer as defined in claim 7, wherein said specified ink dot is formed by one of said at least two waveforms corresponding to a smaller dot diameter.

9. The ink-jet printer as defined in claim 6, wherein when said print data analyzing section detects that a specified dot line having a first color extends adjacent to another dot line having a second color, said driving signal generator generates at least two waveforms, one of which is used for generating a smaller dot diameter for ink dots located in the vicinity of a boundary between said specified dot line and said another dot line.

10. The ink-jet printer as defined in claim 1, further comprising a switch board, wherein said mode selection section selects said printing mode based on an input from said switch board.

11. The ink-jet printer as defined in claim 10, wherein said input from said switch board specifies the type of the printing media, a printing speed, and/or a resolution.

12. The ink-jet printer as defined in claim 11, wherein said head driving section generates a driving pulse corresponding to a larger dot diameter when said input specifies that the printing media is a dedicated printing sheet and generates a driving pulse corresponding to a smaller dot diameter when said input specifies that the printing media is a plain paper.

13. A method for printing an image on a printing media comprising the steps of specifying a printing mode out of a plurality of printing modes based on at least a type of a printing media, selecting at least two waveforms out of a plurality of waveforms based on said specified printing mode, and driving a piezoelectric element based on said selected waveforms.

14. The method as defined in claim 13, wherein said at least one waveform includes a first waveform corresponding to a first dot diameter and a second waveform corresponding to a second dot diameter which is smaller than said first dot diameter.

15. The method as defined in claim 13, wherein said printing mode specifying step is conducted further based on a resolution and/or a printing speed.

* * * * *